US010422612B2

(12) United States Patent
Osdon et al.

(10) Patent No.: US 10,422,612 B2
(45) Date of Patent: Sep. 24, 2019

(54) PROJECTILE, AND WARHEAD ASSEMBLY AND DEPLOYMENT SYSTEM THERFOR

(71) Applicant: ISRAEL AEROSPACE INDUSTRIES LTD., Lod (IL)

(72) Inventors: Tal Osdon, Lod (IL); Herman Margolis, Kfar Saba (IL); Ilan Tiraspolski, Haifa (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 0 days.

(21) Appl. No.: 15/557,409

(22) PCT Filed: Apr. 7, 2016

(86) PCT No.: PCT/IL2016/050373
§ 371 (c)(1),
(2) Date: Sep. 11, 2017

(87) PCT Pub. No.: WO2016/170525
PCT Pub. Date: Oct. 27, 2016

(65) Prior Publication Data

US 2018/0031356 A1 Feb. 1, 2018

(30) Foreign Application Priority Data

Apr. 19, 2015 (IL) ..... 238372

(51) Int. Cl.
*F42B 12/18* (2006.01)
*F42B 15/01* (2006.01)
*F42B 12/62* (2006.01)

(52) U.S. Cl.
CPC ..... *F42B 12/18* (2013.01); *F42B 12/625* (2013.01); *F42B 15/01* (2013.01)

(58) Field of Classification Search
CPC ..... F42B 12/00; F42B 12/02; F42B 12/207; F42B 12/208; F42B 12/18; F42B 12/16;
(Continued)

(56) References Cited

U.S. PATENT DOCUMENTS 3,838,644 A * 10/1974 Prochnow ..... F42B 12/58 102/476
4,770,369 A 9/1988 Flock et al.
(Continued)

FOREIGN PATENT DOCUMENTS

DE 3934041 A1 5/1993
GB 2272962 A 6/1994
(Continued)

OTHER PUBLICATIONS

International Search Report and Written Opinion for International Application No. PCT/IL2016/050373 dated Jul. 18, 2016.

*Primary Examiner* — John Cooper
(74) *Attorney, Agent, or Firm* — Dorsey & Whitney LLP

(57) ABSTRACT

A warhead assembly is provided for a projectile includes a forward module having a precursor warhead, and an aft module including a main warhead. The warhead assembly includes a deployment system for selectively deploying the warhead assembly from a retracted configuration to a deployed configuration, at predetermined conditions, to thereby provide a longitudinal displacement between the forward module and the aft module. The deployment system includes an expansion member accommodated between the forward module and the aft module, and configured for being longitudinally expanded under the predetermined conditions to thereby increase a longitudinal dimension of the expansion member and thereby urge the forward module and the aft module away from one another to provide said
(Continued)

longitudinal displacement. A corresponding deployment system and projectile are also provided.

19 Claims, 5 Drawing Sheets

(58) Field of Classification Search
CPC .. F42B 5/045; F42B 5/03; F42B 5/184; F42B 5/035; F42B 15/01
USPC ..... 102/476, 473
See application file for complete search history.

(56) References Cited

U.S. PATENT DOCUMENTS

| | | | | |
|---|---|---|---|---|
| 4,848,238 | A | 7/1989 | Bocker et al. | |
| 4,944,226 | A * | 7/1990 | Wedertz | F42B 10/18 102/293 |
| 5,007,347 | A | 4/1991 | Greene | |
| 5,460,676 | A | 10/1995 | Jensen et al. | |
| 5,744,746 | A | 4/1998 | Tripptrap et al. | |
| 6,109,185 | A | 8/2000 | Mikhail | |
| 6,178,889 | B1 * | 1/2001 | Dindl | F42B 5/02 102/430 |
| 7,118,072 | B2 | 10/2006 | Kobayashi et al. | |
| 7,800,033 | B1 | 9/2010 | Kusic | |
| 2008/0041265 | A1 * | 2/2008 | Geswender | F02K 7/10 102/476 |

FOREIGN PATENT DOCUMENTS

| | | |
|---|---|---|
| GB | 2433105 A | 6/2007 |
| RU | 2439473 C1 | 1/2012 |
| RU | 140981 U1 | 5/2014 |

* cited by examiner

PROJECTILE, AND WARHEAD ASSEMBLY AND DEPLOYMENT SYSTEM THERFOR

TECHNOLOGICAL FIELD

The presently disclosed subject matter relates to projectiles, in particular projectiles having a precursor warhead and a main warhead in tandem arrangement.

BACKGROUND ART

References considered to be relevant as background to the presently disclosed subject matter are listed below:

U.S. Pat. No. 4,770,369
U.S. Pat. No. 4,848,238
U.S. Pat. No. 4,944,226
U.S. Pat. No. 5,007,347
U.S. Pat. No. 5,460,676
U.S. Pat. No. 5,744,746
U.S. Pat. No. 6,109,185
U.S. Pat. No. 7,118,072

Acknowledgement of the above references herein is not to be inferred as meaning that these are in any way relevant to the patentability of the presently disclosed subject matter.

BACKGROUND

Some types of projectiles are designed with tandem warheads, which include a precursor warhead (sometimes also referred to as a tip charge) in tandem arrangement with a main warhead, i.e., the precursor warhead is longitudinally spaced from the main warhead, and thus the two warheads are designed to hit the same point on the target.

Tandem warheads are well known in the art, having been designed for a variety of missile systems, including for example the TOW 2 wire guided anti-tank missile, by Raytheon.

Such projectiles are often effective against targets that have reactive armor, in which the precursor warhead activates and thus eliminates the reactive armor from the projectile's path, allowing the main warhead to then destroy or damage the now-unprotected target.

Often, such main warheads are provided as so-called shaped-charged warheads (also referred to as chemical energy warheads), and include a metallic liner ahead of an explosive shaped charge. When the shaped charge is detonated, the liner is converted to a hot metallic liquid jet that is directed towards the target.

To work effectively, the precursor warhead must be sufficiently spaced from the main warhead such that detonation of the precursor warhead does not itself damage the main warhead, and furthermore, the main warhead needs to be at a particular "standoff" distance from the target at detonation of the main warhead for maximum effectiveness. At distances greater than the standoff spacing, the metallic jet can break up before reaching the target and is thus less effective, while at distances closer than the stand-off spacing there is insufficient time for the metallic jet to form properly before reaching the target. The optimal standoff distance is often correlated to the diameter of the main warhead or of the shaped charge.

In some such projectiles, where the longitudinal length of the projectile is not an issue, the spacing between the precursor warhead and the main warhead, and the standoff spacing, are mechanically fixed for the projectile at the respective optimum dimensions. However, in some situations where there are restrictions or limits on the longitudinal length of the projectile, there can be conflicting requirements for the projectile length, in which the projectile length may be required be of a length smaller than is consistent with optimal warhead spacing (i.e., the spacing between the precursor warhead and the main warhead), and/or with optimal standoff spacing for the main warhead. One example of such restrictions or limits on the longitudinal length of the projectile includes the storage space or length defined in the bustle (the munitions storage rack) inside a combat tank. Another example of such restrictions or limits is the space within the turret of a combat tank available for maneuvering and loading a shell into the breech of the weapons barrel. In many such cases, it would not be physically possible to store and/or load a projectile having the desired warhead spacing and/or standoff spacing.

Projectiles having a longer longitudinal length after firing, as compared with a smaller longitudinal length up to firing, for a variety of reasons, including for example as discussed above, are known.

For example, the TOW 2A missile by Raytheon includes an extendible probe at the nose of the missile. The probe includes a precursor warhead and a safety and arming device, and the probe is extended in a forward direction from the nose after firing.

Further by way of example U.S. Pat. No. 4,944,226 discloses an expandable telescoped airframe for a missile provides a shorter configuration for convenience in handling and a longer configuration to provide added predetermined clearance in front of a shaped charge warhead after launch. The airframe is mechanically locked into its extended configuration upon deployment of its expansion feature by means of a wedge brake collar. Possible deployment means include gas pressure, one or more springs, and a drogue parachute. Tail and other control surfaces spring open after clearing the airframe tube to provide aerodynamic stability.

Further by way of example U.S. Pat. No. 7,118,072 discloses a flying object using a thin elongated nose cone with a small tip angle for reducing the air resistance during flying, wherein the maximum loading capacity can be increased without decreasing the volume efficiency of the flying object by limitations placed on the accommodation space, regardless of the structure thereof. In the flying object, the nose cone portion has a compressed structure in the axial direction during accommodation and expands on the tip side in the axial direction during flying, due to an expandable nose cone structure such that a disk with a small diameter is disposed in the forward position and the disks with a successively increasing diameter are disposed in the axial direction. After separation, the nose cone expands in the axial direction, deep cavities are formed between the disks, and a fine elongated nose cone with a small tip angle is provided, whereby the air resistance is reduced.

Further by way of example U.S. Pat. No. 5,007,347 discloses a mechanism for upgrading a missile to be effective against reactive armor, and includes an adaptor for mounting a probe module with a warhead. The probe module has a charge in its extensible tip. A faring over the five inch warhead reestablishes the aerodynamics of the missile.

Further by way of example U.S. Pat. No. 5,460,676 discloses a flexible, aerodynamic inflatable nose fairing for use in combination with flat nosed canister launched missiles having a wide circular cylindrical shape. The inflatable nose fairing is fabricated as a fiber-reinforced elastomeric membrane having a laminate construction which includes a silicone rubber inner or base layer as the gaseous pressure membrane or bladder, surrounded by two or more ply layers made up of resin-impregnated yarns. The unbalanced ply stacking facilitates bending in the axial direction and allows the nose fairing to be compactly folded into a shallow stowed position which, in turn, allows for an increase in the payload capacity of the missile.

Further by way of example U.S. Pat. No. 4,770,369 discloses an inflatable aerodynamic surface particularly adapted for improving the aerodynamic smoothness of the forward end of a missile of the type having a relatively blunt forward end with a centrally disposed extendible probe member. In particular, a flexible membrane is provided having a base edge sealingly affixed to the forward edge of the missile casing and an apex affixed to the forward end of the probe. The membrane is inflated by a gas generator to pressurize the inside of the membrane to define a smooth, nose-shaped aerodynamic frontal surface.

GENERAL DESCRIPTION

According to a first aspect of the presently disclosed subject matter there is disclosed a warhead assembly for a projectile, comprising a forward module including a precursor warhead;

an aft module including a main warhead;

the warhead assembly comprising a deployment system for selectively deploying the warhead assembly from a retracted configuration to a deployed configuration, at predetermined conditions, to thereby provide a longitudinal displacement between the forward module and the aft module;

wherein said deployment system comprises an expansion member accommodated between the forward module and the aft module, and configured for being longitudinally expanded under said predetermined conditions to thereby increase a longitudinal dimension of the expansion member and thereby urge the forward module and the aft module away from one another to provide said longitudinal displacement.

For example, said forward module and said aft module are telescopically movable longitudinally with respect to one another. For example, said forward module comprises a first side wall, and said aft module comprises a second side wall. For example, said first side wall and said second side wall are telescopically movable longitudinally with respect to one another. Additionally or alternatively, for example, said expansion member is different from said first side wall or said second side wall.

Additionally or alternatively, for example, said expansion member in the form of an inflatable member, and wherein said deployment system further comprises an actuation system for selectively inflating the inflatable member to provide said deployed configuration. For example, said actuation system comprises a pressurized gas vessel having an outlet and a valve, the valve being operable to open under said predetermined conditions to allow fluid communication between said pressurized vessel and said inflatable member. Additionally or alternatively, for example, said inflatable member comprises a balloon-type body or a bellows-type body.

Additionally or alternatively, for example, said actuation system comprises a pyrotechnic actuator configured for causing the valve to open under said predetermined conditions.

Additionally or alternatively, for example, the forward module includes a nose of the projectile, and wherein said nose and said first side wall are exposed both in the retracted configuration and in the deployed configuration.

Additionally or alternatively, for example, the forward module includes a nose of the projectile, and wherein said nose and said first side wall have an unchanged profile between the retracted configuration and the deployed configuration.

Additionally or alternatively, for example, the forward module includes a seeker head.

Additionally or alternatively, for example, said forward portion and said aft portion have respective external diameters that are within ±10% of one another.

Additionally or alternatively, for example, said predetermined conditions include a measure of a velocity or acceleration indicative of the projectile having been fired from a weapons barrel or other launch equipment and is now free thereof.

Additionally or alternatively, for example, said predetermined conditions include a predetermined time period after the projectile is fired from a weapons barrel or other launch equipment and is now free thereof.

Additionally or alternatively, for example, said predetermined conditions include the warhead assembly having reached a particular height, or range.

According to the first aspect of the presently disclosed subject matter there is also provided a projectile, comprising the warhead assembly as defined above regarding the first aspect of the presently disclosed subject matter. For example, the projectile is configured as any one of a shell, a rocket or a missile.

According to the first aspect of the presently disclosed subject matter there is also disclosed a method for operating a warhead assembly, comprising:

(a) providing the warhead assembly as defined above regarding the first aspect of the presently disclosed subject matter;

(b) selectively deploying the warhead assembly from the retracted configuration to the deployed configuration under said predetermined conditions.

According to the first aspect of the presently disclosed subject matter there is also disclosed a deployment system for warhead assembly for a projectile, the warhead assembly comprising a forward module including a precursor warhead and an aft module including a main warhead;

said deployment system configured for selectively deploying the warhead assembly from a retracted configuration to a deployed configuration, at predetermined conditions, to thereby provide a longitudinal displacement between the forward module and the aft module;

wherein said deployment system comprises an expansion member configured for being accommodated between the forward module and the aft module, and configured for being longitudinally expanded under said predetermined conditions to thereby increase a longitudinal dimension of the expansion member and thereby urge the forward module and the aft module away from one another to provide said longitudinal displacement.

For example, the forward module comprises a first side wall, and the aft module comprises a second side wall, the first side wall and the second side wall being telescopically movable longitudinally with respect to one another, and wherein said expansion member is different from said first side wall or said second side wall.

Additionally or alternatively, for example, said expansion member in the form of an inflatable member, and further comprising an actuation system for selectively inflating the inflatable member to provide said deployed configuration. For example, said actuation system comprises a pressurized gas vessel having an outlet and a valve, the valve being operable to open under said predetermined conditions to allow fluid communication between said pressurized vessel and said inflatable member. Additionally or alternatively, for example, said inflatable member comprises a balloon-type body or a bellows-type body.

Additionally or alternatively, for example, said actuation system comprises a pyrotechnic actuator configured for causing the valve to open under said predetermined conditions.

According to a second aspect of the presently disclosed subject matter there is disclosed a warhead assembly for a projectile, comprising a forward module including a precursor warhead;

an aft module including a main warhead;

the warhead assembly comprising a deployment system for selectively deploying the warhead assembly from a retracted configuration to a deployed configuration, at predetermined conditions, to thereby provide a longitudinal displacement between the forward module and the aft module;

wherein the forward module includes a nose of the projectile and forward external side walls of the projectile, said nose and said forward external side walls being exposed both in the retracted configuration and in the deployed configuration.

For example, said nose and said forward external side walls have an unchanged profile between the retracted configuration and the deployed configuration. Additionally or alternatively, for example, the forward module includes a seeker head. Additionally or alternatively, for example, said deployment system comprises an expansion member accommodated between the forward module and the aft module, and configured for being longitudinally expanded under said predetermined conditions to thereby increase a longitudinal dimension of the expansion member and thereby urge the forward module and the aft module away from one another to provide said longitudinal displacement.

According to a third aspect of the presently disclosed subject matter there is disclosed a warhead assembly for a projectile, comprising a forward module including a precursor warhead;

an aft module including a main warhead;

the warhead assembly comprising a deployment system for selectively deploying the warhead assembly from a retracted configuration to a deployed configuration, at predetermined conditions, to thereby provide a longitudinal displacement between the forward module and the aft module;

wherein the forward module includes a nose of the projectile and forward external side walls of the projectile, said nose and said forward external side walls have an unchanged profile between the retracted configuration and the deployed configuration.

For example, the forward module includes a seeker head. Additionally or alternatively, for example, said deployment system comprises an expansion member accommodated between the forward module and the aft module, and configured for being longitudinally expanded under said predetermined conditions to thereby increase a longitudinal dimension of the expansion member and thereby urge the forward module and the aft module away from one another to provide said longitudinal displacement.

According to a fourth aspect of the presently disclosed subject matter there is disclosed a warhead assembly for a projectile, comprising a forward module including a precursor warhead;

an aft module including a main warhead;

the warhead assembly comprising a deployment system for selectively deploying the warhead assembly from a retracted configuration to a deployed configuration, at predetermined conditions, to thereby provide a longitudinal displacement between the forward module and the aft module;

wherein the forward module includes (and in particular accommodates) a seeker head.

For example, said deployment system comprises an expansion member accommodated between the forward module and the aft module, and configured for being longitudinally expanded under said predetermined conditions to thereby increase a longitudinal dimension of the expansion member and thereby urge the forward module and the aft module away from one another to provide said longitudinal displacement.

According to a fifth aspect of the presently disclosed subject matter there is disclosed a warhead assembly for a projectile, comprising a forward module including a precursor warhead;

an aft module including a main warhead;

the warhead assembly comprising a deployment system for selectively deploying the warhead assembly from a retracted configuration to a deployed configuration, at predetermined conditions, to thereby provide a longitudinal displacement between the forward module and the aft module;

wherein said deployment system comprises an expansion member accommodated between the forward module and the aft module, and configured for being longitudinally expanded under said predetermined conditions to thereby increase a longitudinal dimension of the expansion member and thereby urge the forward module and the aft module away from one another to provide said longitudinal displacement.

Optionally, in the warhead assembly according to any one of the above, second, third, fourth or fifth aspects of the presently disclosed subject matter, said forward portion and said aft portion are telescopically movable longitudinally with respect to one another.

Additionally or alternatively, for example, said forward portion and said aft portion have respective external diameters that are within ±10% of one another.

For example, the precursor warhead and the main warhead are in tandem arrangement.

For example, in the deployed configuration, the warhead assembly provides a standoff ratio of about 5.

For example, in the deployed configuration, the warhead assembly provides a standoff ratio of between 4 and 6.

For example, in the deployed configuration, the warhead assembly provides a standoff distance for the main warhead that is about 5 times the diameter of the forward module.

For example, in the deployed configuration, the warhead assembly provides a standoff distance for the main warhead that is about between 4 and 6 times the diameter of the forward module.

Additionally or alternatively, for example, said deployment system comprises an expansion member accommodated between the forward module and the aft module, and configured for being longitudinally expanded under said predetermined conditions to thereby increase a longitudinal dimension of the expansion member, and thereby urge the forward module and the aft module away from one another to provide said longitudinal displacement. For example, said expansion member in the form of an inflatable member, and wherein said deployment system further comprises an actuation system for selectively inflating the inflatable member to provide said deployed configuration. For example, said actuation system comprises a pressurized gas vessel having an outlet and a valve, the valve being operable to open under said predetermined conditions to allow fluid communication between said pressurized vessel and said inflatable member. For example, said inflatable member comprises a balloon-type body; or said inflatable member comprises a bellows-type body; or said expansion member is defined by a plurality of telescopic members, wherein one said telescopic member is affixed to the forward module and wherein a second said telescopic member is affixed to the aft module, and wherein said telescopic members are telescopically deployable along the longitudinal direction to provide said longitudinal displacement.

Additionally or alternatively, for example, said actuation system comprises a pyrotechnic actuator configured for causing the valve to open under said predetermined conditions.

Additionally or alternatively, for example, said predetermined conditions include a measure of a velocity or acceleration indicative of the projectile having been fired from a weapons barrel or other launch equipment and is now free thereof.

Additionally or alternatively, for example, said predetermined conditions include a predetermined time period after the projectile is fired from a weapons barrel or other launch equipment and is now free thereof.

Additionally or alternatively, for example, said predetermined conditions include the warhead assembly having reached a particular height, or range.

According to any one of the second, third, fourth, or fifth aspects of the presently disclosed subject matter there is provided a projectile, comprising the warhead assembly as defined above regarding any one of the second, third, fourth, or fifth aspects of the presently disclosed subject matter. For example, the projectile is configured as any one of a shell, a rocket or a missile.

According to a sixth aspect of the presently disclosed subject matter there is disclosed a method for operating a warhead assembly, comprising:

(a) providing the warhead assembly as defined above regarding any one of the second, third, fourth or fifth aspects of the presently disclosed subject matter;

(b) selectively deploying the warhead assembly from the retracted configuration to the deployed configuration under said predetermined conditions.

A feature of at least some examples of the presently disclosed subject matter is that a deployment system can be provided that can be selectively operated to provide fast deployment of the warhead assembly to the deployed configuration.

Another feature of at least some examples of the presently disclosed subject matter is that a deployment system can be provided that can be selectively operated to provide reliable deployment of the warhead assembly to the deployed configuration.

Another feature of at least some examples of the presently disclosed subject matter is that a deployment system can be provided that can be easily installed in a warhead assembly of the type disclosed herein to enable deployment of the warhead to the deployed configuration.

Another feature of at least some examples of the presently disclosed subject matter is that a deployment system can be provided that can be easily replaced in a warhead assembly of the type disclosed herein (for example in case of malfunction of the deployment system) to enable deployment of the warhead to the deployed configuration.

Another feature of at least some examples of the presently disclosed subject matter is that a deployment system can be provided that is self-contained and operates in a self-contained manner to expand from an unexpanded form to an expanded form, to thereby enable, when installed in a warhead assembly of the type disclosed herein, deployment of the warhead to the deployed configuration.

Another feature of at least some examples of the presently disclosed subject matter is that a deployment system can be provided that is self-contained and operates in a self-contained manner to expand from an unexpanded form to an expanded form, and thus does not require any sliding sealing arrangement to be provided between the telescoping sections of the forward module and the aft module to thereby enable deployment of the warhead to the deployed configuration.

Another feature of at least some examples of the presently disclosed subject matter is that the respective nose, including the respective seeker head and the respective precursor warhead, is longitudinally displaced from the main warhead as an integral unit.

Another feature of at least some examples of the presently disclosed subject matter is that the warhead assembly, including at least the respective precursor warhead, substantially maintains its cross-sectional shape as the warhead assembly is deployed from the retracted configuration to the deployed configuration.

Another feature of at least some examples of the presently disclosed subject matter is that the point in the trajectory at which the warhead assembly is deployed from the retracted configuration to the deployed configuration can be controlled, for example either at the factory or prior to firing/launching the projectile.

Another feature of at least some examples of the presently disclosed subject matter is that the deployment time, i.e., the elapsed time for deploying the warhead assembly from the retracted configuration to the deployed configuration, can be controlled, for example either at the factory or prior to firing/launching the projectile. For example, where it is intended for the projectile to have a relatively short range, the deployment time can be set to be short to thereby ensure that the warhead assembly is fully deployed in good time before the target is hit. Alternatively, for example, where it is intended for the projectile to have a relatively long range, the deployment time can be set to be longer such as to have a minimal impact on the longitudinal static stability of the projectile in flight.

Another feature of at least some examples of the presently disclosed subject matter is that the longitudinal spacing between the precursor warhead and the main warhead can be improved as compared with at least some conventional systems.

Another feature of at least some examples of the presently disclosed subject matter is that the stand-off spacing between the main warhead and the tip of the projectile can be improved as compared with at least some conventional systems.

Another feature of at least some examples of the presently disclosed subject matter is that a warhead assembly and corresponding projectile can be provided having a compact size corresponding to the retracted configuration, and which can fit and handled in a relatively small space prior to being fired/launched, and which can expand to a deployed configuration having the desired geometrical dimensions after being fired and travelling in free motion. For example, the compact size of the projectile remains unchanged until after firing and exit from the weapons barrel.

By "travelling" of the warhead assembly is meant the motion of the warhead assembly through a fluid medium or a vacuum (for example when the warhead assembly is part of a projectile), in particular the Earth's atmosphere or space. By "free motion conditions" is meant that the warhead assembly (for example when part of a projectile), is effectively not being mechanically supported on the ground or by another vehicle, either directly or indirectly, while travelling in the medium or a vacuum, in particular the Earth's atmosphere or space, whether powered or unpowered.

BRIEF DESCRIPTION OF THE DRAWINGS

In order to better understand the subject matter that is disclosed herein and to exemplify how it may be carried out in practice, examples will now be described, by way of non-limiting example only, with reference to the accompanying drawings, in which:

FIG. 1(*b*) schematically illustrates in side view the example of the warhead assembly of FIG. 1(*a*) configured as part of a projectile in the form of a rocket or missile.

FIG. 4(*b*) illustrates in longitudinal cross-sectional side view the example of a deployment system of FIG. 4(*a*), taken along A-A.

FIG. 5(*b*) illustrates in longitudinal cross-sectional side view the example of a deployment system of FIG. 5(*a*), taken along B-B.

DETAILED DESCRIPTION

Figure 2A:
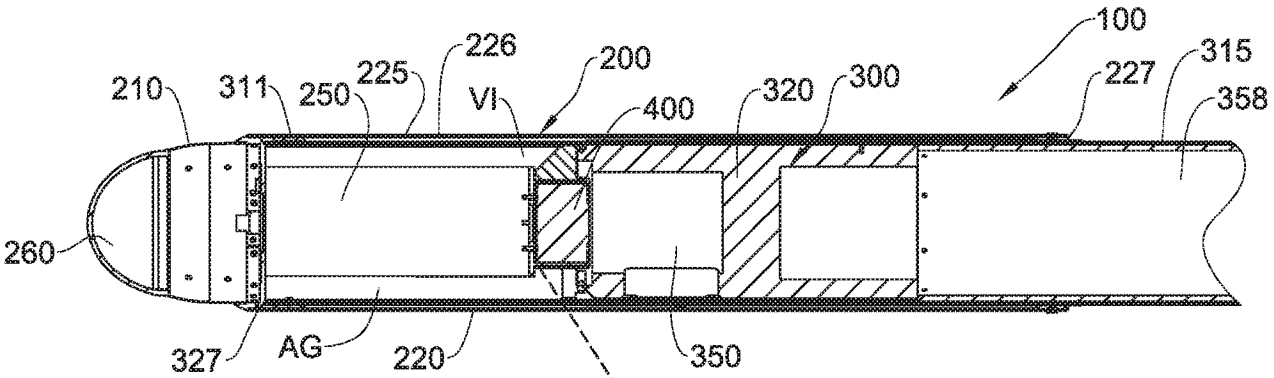
FIG. 2(*a*) and FIG. 2(*b*) illustrate in longitudinal cross-sectional side view, the example of the warhead assembly of FIG. 1(*a*) and FIG. 1(*b*), in retracted configuration and in deployed configuration, respectively.
Figure 2B:
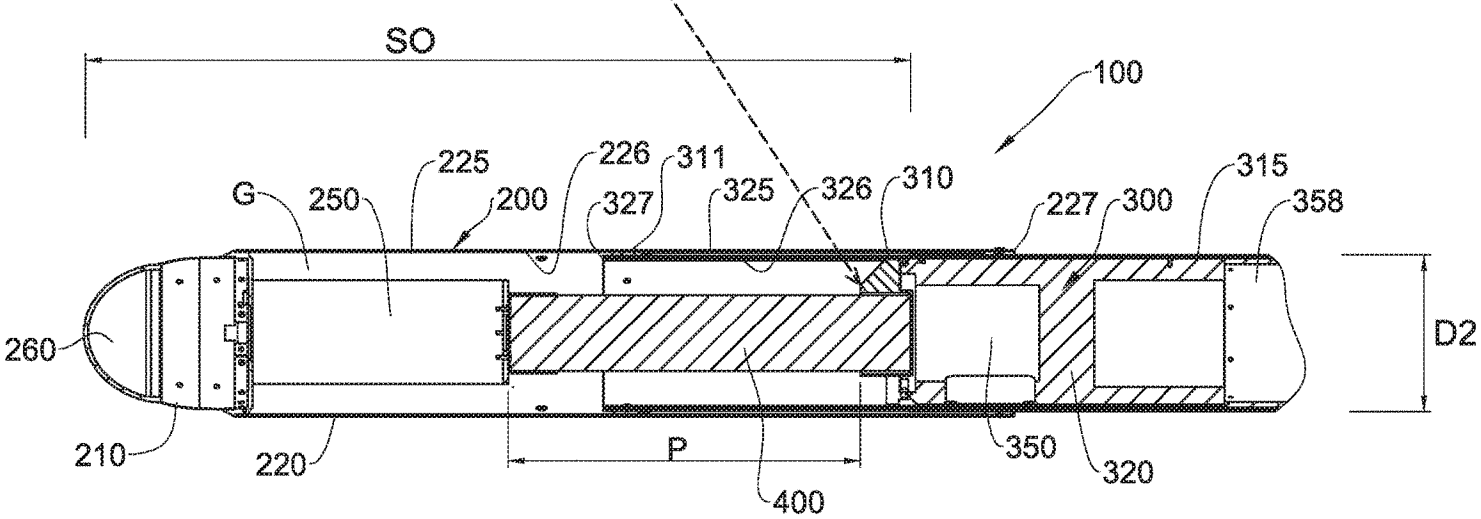
Figures 3A, 3B:
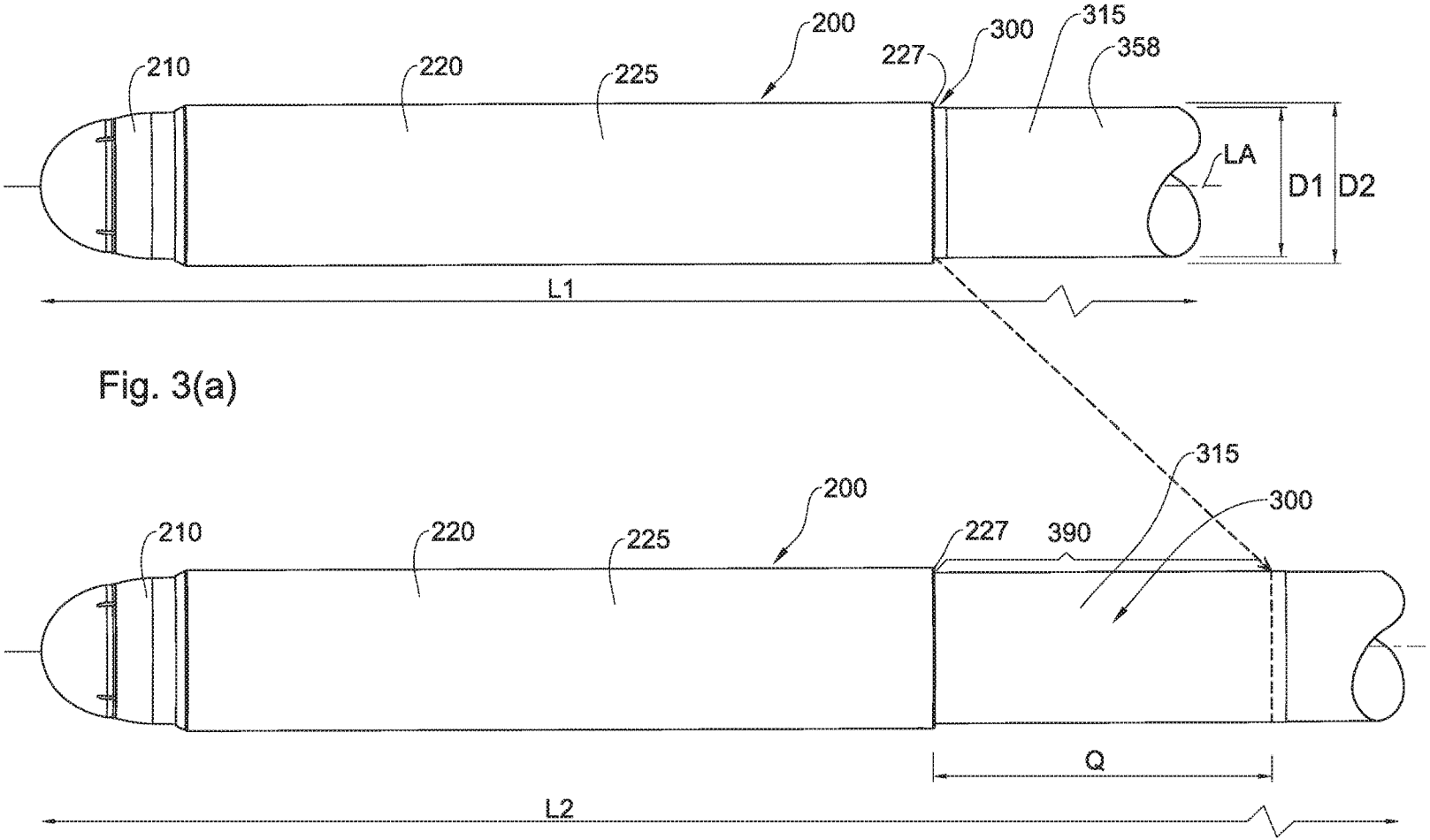
FIG. 3(*a*) and FIG. 3(*b*) illustrate in side view, the example of the warhead assembly of FIGS. 1(*a*) to 2(*b*), in retracted configuration and in deployed configuration, respectively.

Referring to FIGS. 2(*a*), 2(*b*), 3(*a*) and 3(*b*), a warhead assembly according to a first example of the presently disclosed subject matter, generally designated 100, comprises a forward module 200 and an aft module 300, and a deployment system 400.

Figure 1A:
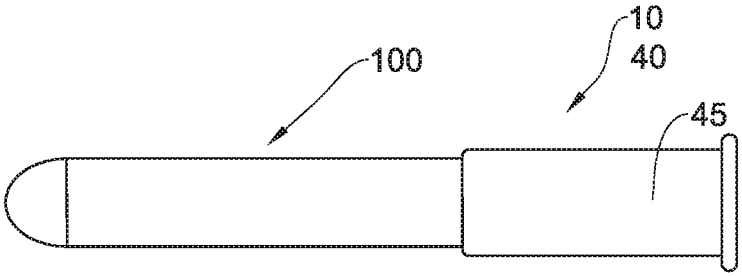
FIG. 1(*a*) schematically illustrates in side view an example of the warhead assembly according to the presently disclosed subject matter, configured as part of a projectile in the form of shell.
Figure 1B:
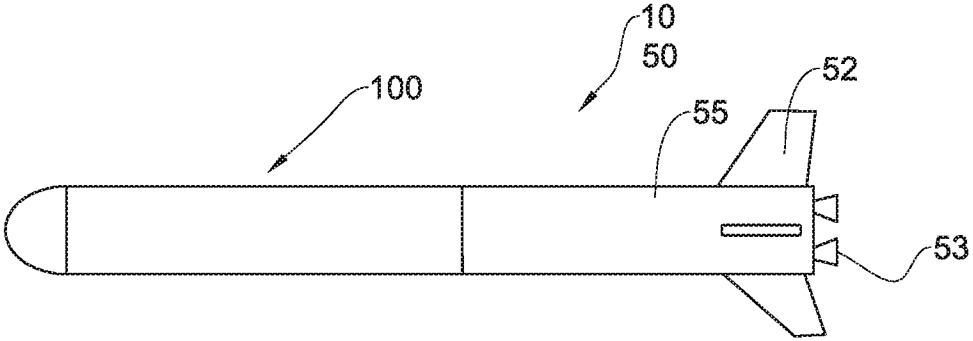

Referring to FIG. 1(*a*), the warhead assembly 100 can be configured as part of a projectile 10 in the form of shell 40, to be fired from breech loaded gun barrel, for example, of a combat tank or of a self propelled gun or of an artillery piece for example, the shell 40 comprising cartridge case 45 housing a suitable propellant (not shown). Alternatively, and referring to FIG. 1(*b*), the warhead assembly 100 can be configured as part of a projectile 10 in the form of a rocket or missile 50, to be fired from a suitable rocket launcher, and comprising a body section 55 including fins 52, for example, and propulsion system 53.

In any case, the forward module 200 comprises a precursor warhead 250, which in this example is configured as a shaped charge, including a copper liner, or indeed any other suitable metal liner (not shown) and explosive charge (not shown), as is known in the art. In this example, the precursor warhead 250 is configured for detonating on impact of the warhead assembly 100 with a target, and in particular for activating armor reactive material from the path of the projectile 10. In alternative variations of this example the precursor warhead 250 can comprise any other suitable warhead, including for example, a kinetic warhead, a fragmentation warhead, combined warheads (comprising for example a shaped charge and a fragmentation charge), and so on.

The forward module 200 includes a nose 210 and forward projectile casing in the form of forward external side walls 220 (also referred to herein as first side wall) of the projectile 10. The forward external side walls 220 project in a general aft direction from the nose and define an internal volume V1. In this example the projectile has generally circular transverse cross-sections along the longitudinal axis LA, and the external side walls 220 are tubular having a cylindrical outer surface 225, an inner cylindrical surface 226, and an aft edge 227. The precursor warhead 250 is accommodated within the internal volume V1, at a forward position just aft of the nose 210. In alternative variations of this example, the projectile has any other suitable transverse cross-sections along the longitudinal axis LA, for example oval, triangular or other polygonal cross-section In this example the nose 210 has a dome-shaped or ogive-shaped forward-facing portion. The precursor warhead 250 is radially spaced from inner cylindrical surface 226 via annular gap AG.

In this example, the forward module 200 comprises a seeker head 260 accommodated in the nose 210. In this example the forward-facing portion is transparent to electromagnetic radiation of a desired wavelength range, for example corresponding to visible light and/or infra-red light and/or ultraviolet light. The seeker head 260 provides a homing function to the projectile 10, and can include, for example infra-red sensors, optical sensors and a suitable controller (not shown) for detecting a desired target and for providing homing instructions to the projectile 10 for steering the projectile 10 to the target.

In alternative variations of this example the seeker head can be omitted or replaced with any other suitable homing system, for example laser guided systems or laser homing systems.

The aft module 300 also comprises a main warhead housing 320, forward of the aft portion 358 of the projectile, and side wall 315 (also referred to herein as second side wall) including a sheath 310 affixed to and projecting forward of the main warhead housing 320.

The aft module 300 comprises a main warhead 350, accommodated in the main warhead housing 350. The main warhead 350 in this example is configured as a shaped charge, including a copper liner, or indeed any other suitable metal liner (not shown) and explosive charge (not shown), as is known in the art. In this example, the main warhead 350 is configured for detonating when the forward module 200 impacts the target. In this example, the main warhead 350 is also configured for destroying or damaging the target, in particular where armor reactive material has been removed from the path of the projectile by detonation of the precursor warhead 250. In alternative variations of this example the main warhead 350 can comprise any suitable warhead, including for example, a kinetic warhead, a fragmentation warhead, combined warheads (comprising for example a shaped charge and a fragmentation charge), and so on.

In this example, in which the projectile has generally circular transverse cross-sections along the longitudinal axis LA, the sheath 310 is tubular having a cylindrical sheath outer surface 325, a cylindrical inner sheath surface 326, and a sheath forward edge 327. The sheath 310 (and thus the second side wall 315) is telescopically mounted with respect to the forward module 200, in particular telescopically mounted with respect to the tubular external side walls 220. Thus, at least the sheath 310 is concentric with external side walls 220, and the cylindrical outer surface 325 is facing the cylindrical inner surface 226 and spaced therefrom by spacing S, which in this example is annular. A sliding sealing ring 311 is affixed to the forward end of cylindrical sheath outer surface 325 and provides a sliding seal with respect to the inner cylindrical surface 226.

In alternative variations of this example, in which the projectile does not have a generally circular transverse cross-sections along the longitudinal axis LA (for example, having instead an oval or polygonal (for example triangular) cross-section), the sheath 310 can also be tubular but having a sheath outer surface that is complementary to the shape of the respective inner surface of the forward module. The respective sheath is also telescopically mounted with respect to the forward module, in particular telescopically mounted with respect to the respective tubular external side walls of the forward module, which have a corresponding non-circular cross-section (for example, having instead an oval or polygonal (for example triangular) cross-section). Thus, the respective sheath is still generally concentric with external side walls of the forward module, and the respective sheath outer surface is also facing the respective inner surface of the forward module and spaced from this inner surface by a corresponding spacing. A sliding sealing ring of appropriate shape is affixed to the forward end of the corresponding sheath outer surface and provides a sliding seal with respect to the corresponding inner surface of the forward module.

As will become clearer herein, the deployment system 400, which is per se novel, is configured for, and thus operates to, selectively deploy the warhead assembly 100 from a retracted configuration to a deployed configuration, at predetermined conditions.

In the retracted configuration, illustrated in FIGS. 2(*a*) and 3(*a*), a control portion 390 of the aft module 300 is enclosed within the inner volume V1, and the warhead assembly 100 has a minimum axial length L1. In the deployed configuration, illustrated in FIGS. 2(*b*) and 3(*b*), the control portion 390 of the aft module 300 is axially displaced out of the inner volume V1, and is exposed, and the warhead assembly 100 has a maximum axial length L2. The deployment system 400 thus operates to selectively deploy the warhead assembly 100 to provide a longitudinal displacement Q between the forward module 200 and the aft module 300, wherein the longitudinal displacement Q is the difference (L2−L1).

By a component being "exposed" is meant that the component is exposed with respect to the external environment, for example the atmosphere or the vacuum of space, at least when the warhead assembly 100 (e.g. when this is part of the projectile 10) is travelling under free motion conditions.

A forward portion of the aft module, forward of the control portion 390 and including the sheath 310, is enclosed within the inner volume V1 in both the retracted configuration and the deployed configuration, but in two different longitudinal positions relative to the forward external side walls 220. The sealing ring 311 sliding seals between the inner cylindrical surface 226 and the cylindrical outer surface 325 as the aft module 300 is longitudinally displaced with respect to the forward module 200 between the retracted configuration and the deployed configuration.

In the retracted configuration the forward edge 327 of the sheath 310 is at its most forward position, just behind the nose 210, and the precursor warhead 250 is accommodated within the forward part of the sheath 310.

In this example the sheath 310 provides mechanical rigidity to the warhead assembly 100 at least in the deployed configuration, as well as mechanical stability during the deployment between the retracted configuration and the deployed configuration. On the other hand, it is to be noted that in alternative variations of this example the sheath 310 can be omitted, and the required rigidity and stability is provided by other parts of the aft module 300 and the forward module 200.

As can be clearly understood, the nose 210 and the forward external side walls 220 are exposed, both in the retracted configuration and in the deployed configuration. In other words, the external profile of the forward module 200, in particular of the nose 210 and forward external side walls 220, is unchanged between the retracted configuration and the deployed configuration. On the other hand, the control portion 390, which is a portion of the aft module 300 well aft of the nose 210, is not exposed in the retracted configuration, but is exposed in the deployed configuration.

In this example, the forward module 200, in particular the forward external side walls 220 (and optionally also the maximum diameter of the nose 210), have an external diameter D2, while at least the control portion 390 has an external diameter D1. Thus, in this example, the external diameter D2 is larger than external diameter D1, and the diameter ratio D2/D1 can be up to 1.1, for example, though in alternative variations of this example, the diameter ratio can be much larger, for example the external diameter D1 being the minimum possible given the physical constraints imposed by the deployment system 400.

While in this example aft portion 358, at least immediately aft of the control portion 390, also has an external diameter D1 that is smaller than diameter D2, in alternative variations of this example this aft portion 358 of the aft module 300 can instead have an external diameter similar to D2, or alternatively an external diameter that is less than D1.

It is to be noted that in yet other alternative variations of this example, the forward module and the aft module can be configured differently, for example such that the respective control portion is fixedly attached to an aft end of the forward module instead of being fixed to the aft module. In this case, the aft module has a forward sheath that is telescopically movably mounted with respect to an external surface of the control portion. Thus, in the retracted portion, the sheath covers the control volume, while in the deployed configuration the sheath is displaced aft exposing the control portion. In this case the respective forward external side walls of the forward module can be very small axially, and optionally be integrated with the back end of the nose. Thus, while the nose has a maximum diameter D2, the control portion has a smaller external diameter D1.

In any case, and referring to FIG. 2(*b*) in particular, in the deployed configuration the stand-off distance SO (see FIG. 2(*b*)) between the main warhead 350 and the tip of the nose 210 is greater than in the retracted configuration. In this example, in the deployed configuration the ratio of the stand-off distance SO to the external diameter D2 (referred to herein as the standoff ratio), is about 5, which is considered optimal. In alternative variations of this example, the standoff ratio of the stand-off distance SO to the external diameter D2 can be, instead of 5, any other suitable value, for example 4 or 6 or any other value between 4 and 6.

In this example, the forward module 200, for example the nose 210, comprises an impact fuse. On impact with a target, the impact fuse detonates the precursor warhead 250 so that a molten jet is formed within the standoff distance SO from the target (when the precursor warhead 250 is in the form of a shaped charge).

In alternative variations of this example, other types of fuses, for example a proximity fuse, can be used instead of the impact fuse to ensure detonation at a proper standoff distance.

As mentioned above, the deployment system 400 operates to selectively deploy the warhead assembly 100 from the retracted configuration to the deployed configuration, at predetermined conditions, to provide the required longitudinal displacement Q between the forward module 200 and the aft module 300.

As will also become clearer herein, the deployment system 400 comprises an expansion member accommodated between the forward module 200 and the aft module 300, and configured for being longitudinally expanded under said predetermined conditions to thereby increase a longitudinal dimension of the expansion member, and thereby urge the forward module 200 and the aft module 300 away from one another to provide the longitudinal displacement Q.

Figure 4A:
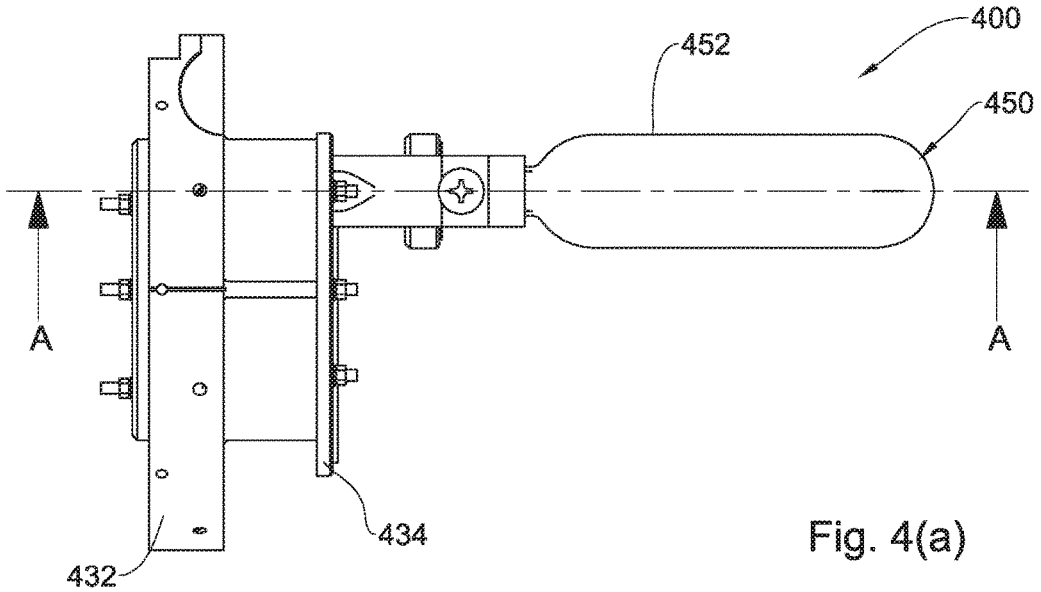
FIG. 4(*a*) illustrates in top view an example of a deployment system according to the presently disclosed subject matter, in the retracted configuration, comprised in the example of the warhead assembly of FIGS. 1(*a*) to 3(*b*)
Figure 4B:
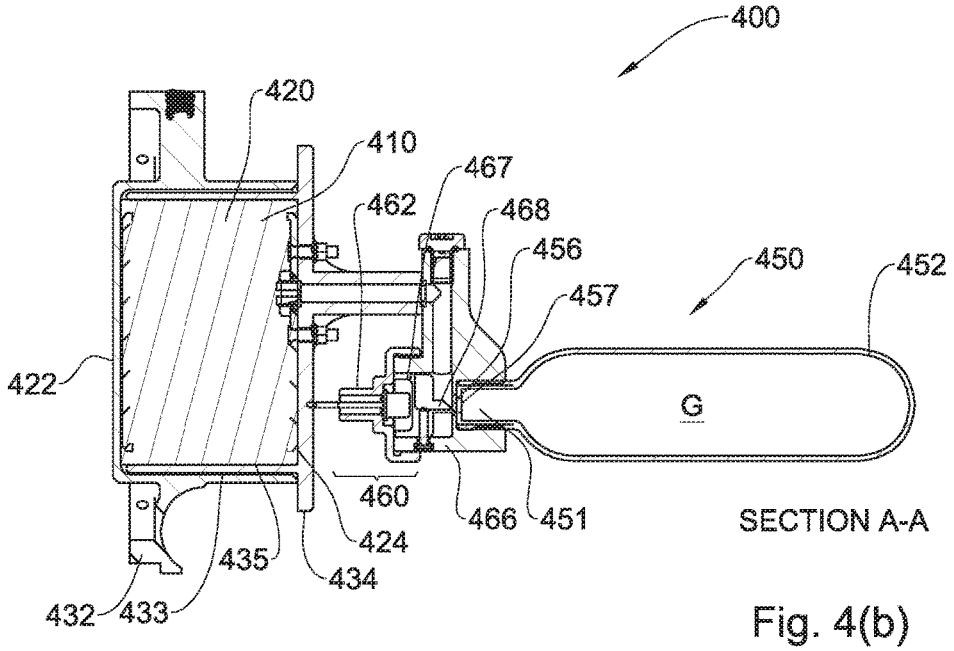

Referring to FIGS. 4(*a*), 4(*b*), 5(*a*) and 5(*b*), an example of the deployment system 400 comprises the expansion member in the form of inflatable member 410, and further comprises an actuation system 450 for selectively inflating the inflatable member 410.

Figure 5A:
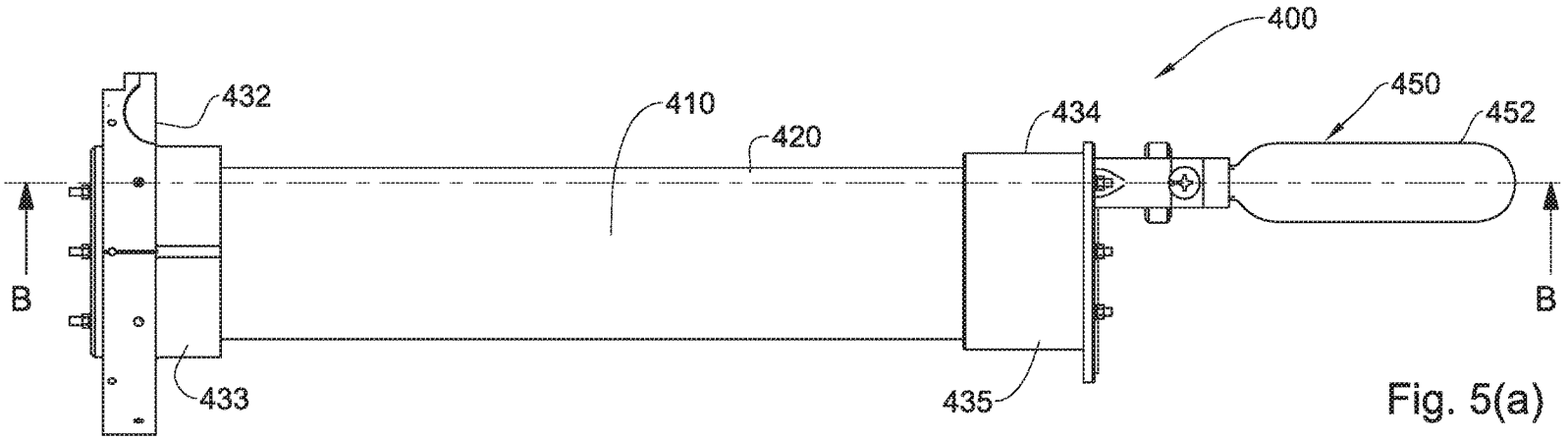
FIG. 5(*a*) illustrates in top view the example of a deployment system of FIGS. 4(*a*) and 4(*b*), in the deployed configuration.
Figure 5B:
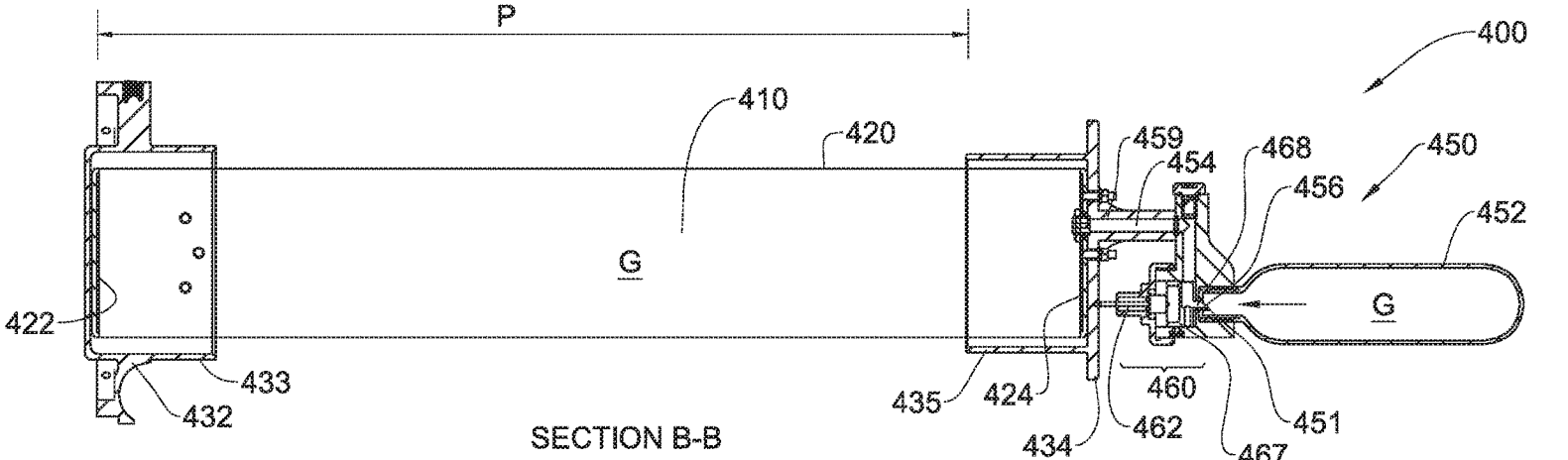

The inflatable member 410 has a compact deflated form (also referred to interchangeably herein as an unexpanded form), illustrated in FIGS. 4(*a*) and 4(*b*) and a longitudinal elongate form (also referred to interchangeably herein as an expanded form) when inflated, illustrated in FIGS. 5(*a*) and 5(*b*).

In this example, the inflatable member 410 has a balloon-type body 420, for example a gas bag, having a longitudinal front end 422, affixed to forward bracket 432, and a longitudinal aft end 424, affixed to aft bracket 434. The forward bracket 432 is configured to be affixed to the forward module 200, for example to the aft end of the precursor warhead 250. The aft bracket 434 is configured to be affixed to the aft module 300, for example to the front end of the main warhead housing 320. As can be seen best in FIGS. 4(*b*) and 5(*b*), the forward bracket 432 comprises an aft projecting peripheral side wall 433, and the aft bracket 434 comprises a forward projecting peripheral side wall 435. In the retracted configuration, the forward projecting peripheral side wall 435 is nested within the aft projecting peripheral side wall 433, defining an enclosed cavity which accommodates the deflated or unexpanded body 420. In the deployed configuration, with the body 420 fully inflated or expanded, the forward bracket 432 separates from and distances from the aft bracket 434, while the front end 422 remains affixed to forward bracket 432, and the aft end 424 remains affixed to aft bracket 434.

The inflatable member 410 is selectively inflated to the fully inflated condition via the action of the actuation system 450. In this example, the actuation system 450 comprises a pressurized gas vessel 452 (containing a suitable pressurized gas G, for example nitrogen, carbon dioxide, etc) under positive gauge pressure) in selective fluid communication via a conduit 454 and actuable valve 456. Thus, the pressurized gas vessel 452 has an outlet 451 connected to an inlet 459 of the body 420 (located at the aft bracket 434) via conduit 454. Valve 456 is a one-time valve and is in the form of a puncturable or otherwise rupturable membrane 457 provided at the outlet 451. The actuation system 450 further comprises an actuation mechanism 460, including a piercing member 468, for example a sharp pin, blade or knife, driven by a piston 467, which is in turn reciprocable within a chamber 466 between a distal position and a proximal position. In the distal position, illustrated in FIG. 4(*b*), the piercing member 468 is spaced from the membrane 457, which is intact, and thus the pressurized gas G remains in the pressurized gas vessel 452. In the proximal position, the piercing member 468 is in a position to puncture or otherwise pierce the membrane 457, thereby allowing the pressurized gas G in the pressurized gas vessel 452 to flow to the body 420, through the hole or puncture, via the conduit 454, and thereby inflate the body 420.

In this example the body 420 is configured to inflate to a cylindrical prismatic shape, i.e. having a transverse cylindrical (or other suitable cross-section shape—for example oval polygonal etc.) uniform cross-section along its longitudinal length, though other shapes are of course possible. In this example the body 420 is formed from an elastic material, though in other variations of this example this is not necessarily always the case—for example the body can be folded multiple times, or can be in an accordion shape (for example having a bellows-type body), and is expanded to the deployed configuration without any significant stretching of the body material.

Optionally, the body 420 can be shaped or otherwise configured for facilitating expansion thereof in the longitudinal direction preferentially. For example, the body 420 can optionally comprise longitudinal ribs.

In alternative variations of this example the expansion member can comprise, instead of or in addition to the inflatable body, a series of nested telescopic sections that operates to telescopically expand axially when the gas G is fed thereto. For example, the expansion member can be defined by a plurality of telescopic members, wherein one telescopic member is affixed to forward bracket 432 (and thus to the forward module), another telescopic member is affixed to the aft bracket 434 (and thus to aft module), and the telescopic members are telescopically deployable along the longitudinal direction to provide the longitudinal displacement Q.

In alternative variations of this example pressurized gas vessel can be replaced with any suitable generator of gas, foam or other fluid that is configured for generating quickly a large volume of corresponding fluid that can easily and quickly be fed to the expansion member.

The actuation mechanism 460 also includes a driver 462 for selectively driving the piston 467 from distal position and a proximal position, to thereby pierce the membrane 457. In this example, the driver 462 is in the form of a pyrotechnic actuator including a pyrotechnic charge that can be fired on receipt of a suitable signal from a controller (not shown) comprised in the warhead assembly 100. Firing of the pyrotechnic charge results in a force being induced to the piston 467, which is thereby driven in a proximal direction, driving the piercing member 468 to puncture or otherwise rupture the membrane 457, thus allowing the body 420 to become inflated.

As the body 420 becomes inflated, the longitudinal dimension thereof increases by an amount P (see FIG. 2(*b*) and FIG. 5(*b*)), corresponding to the longitudinal displacement Q, driving the forward module 200 away from the aft module 300.

It is evident that the expansion member, in the form of the inflatable member or the body 420 or in the form corresponding to other examples herein, is different from and independent of the first wall 210 or second wall 315 of the warhead assembly.

It is also evident that deployment system 400 can be selectively operated to provide fast deployment of the warhead assembly to the deployed configuration.

It is also evident that deployment system 400 can be selectively operated to provide reliable deployment of the warhead assembly to the deployed configuration.

It is also evident that deployment system 400 can be easily installed in the warhead assembly to enable deployment of the warhead to the deployed configuration.

It is also evident that deployment system 400 can be easily replaced in the warhead assembly (for example in case of malfunction of the deployment system) to enable deployment of the warhead to the deployed configuration.

It is also evident that deployment system 400 is essentially self-contained and operates in a self-contained manner to expand from an unexpanded form to an expanded form, to thereby enable, when installed in the warhead assembly, deployment of the warhead to the deployed configuration.

It is also evident that deployment system 400 operates in a self-contained manner to expand from an unexpanded form to an expanded form, and thus does not require any sliding sealing arrangement to be provided between the telescoping sections of the forward module and the aft module, in particular between the first wall 220 and the second wall 315, to thereby enable deployment of the warhead to the deployed configuration.

It is to be noted that the warhead assembly 100 is configured for allowing the forward module 200 to be moved away from the aft module 300 in the longitudinal direction with relatively little or no resistance, thereby facilitating deployment from the retracted configuration to the deployed configuration.

Optionally, a small amount of mechanical resistance can be provided at the beginning of such a displacement, to prevent accidental or unwanted deployment, for example prior to the projectile 10 being fired/launched. For example, such mechanical resistance can be provided by a rounded mechanical protrusion located on each of the inner cylindrical surface 226 and the cylindrical outer surface 325—the two protrusions being in contact with one another at the retracted configuration, and a small threshold force needs to be applied to push them apart and thereby allow the forward module 200 to be moved away from the aft module 300 in the longitudinal direction.

Further optionally, the warhead assembly 100 is configured for locking the forward module 200 with respect to the aft module 300 in the deployed configuration, once the deployed configuration is achieved. In this manner, the deployed configuration, and thus the longitudinal displacement Q, is maintained after deployment, independently of the state of the body 420. In this manner, even if the body 420 is damaged after deployment and begins to deflate, for example, this will not affect the longitudinal displacement Q. Such locking can be provided, for example, with snap-fit mechanical locks. Such snap-fit mechanical locks can comprise, for example, a wedge-shaped member on each of the inner cylindrical surface 226 and the cylindrical outer surface 325, in which the diagonal surfaces of the two wedges can slide over one another as the forward module 200 is being displaced from the aft module 300, but once in the deployed configuration the two diagonal surfaces overshoot allowing the blunt ends of the wedges to contact one another and prevent reverse movement between the forward module 200 and the aft module 300.

In this example, the inflatable member provides a short deployment time for a very fast deployment of the warhead assembly 100 to the deployed configuration from the retracted configuration, even where the range to target (from the firing point) is short. For example, the above example of deployment system 400 comprising inflatable member 410 and actuation system 450 can be configured for deploying the warhead assembly to the deployed mode in 2 seconds or less.

It is to be noted that, in at least some variations of this example, the deployment system 400 can be configured for providing a desired deployment time, which can be pre-set at the factory, or just prior to firing/launching the projectile, for example. For example, referring to FIGS. 4(*a*) and 4(*b*), the piercing member 468 is formed as a needle or wedge-shaped blade having a sharp tip facing the membrane 457, and the deployment system 400 can be configured for enabling controlling the depth of penetration of the piercing member 468 through the membrane 457, and thereby controlling the size of the open area of the puncture or rupture in the membrane 457 (due to the increasing cross-sectional area of the piercing member 468 in a direction away from the tip), when punctured or otherwise ruptured by the piercing member 468. In turn, the larger this open area is, the faster the pressurized gas G is released to the body 420, and thus the faster the body 420 becomes fully inflated, and thus the shorter the corresponding deployment time. Conversely, the smaller this open area is, the slower the pressurized gas G is released to the body 420, and thus the slower the body 420 becomes fully inflated, and thus the longer the corresponding deployment time. The size of the open area made by piercing member 468 in the membrane 457 can be controlled in a number of different ways. For example, a mechanical stop (not shown) can be provided to limit the travel of the piston 467 or to limit the travel of the piercing member 468 in the proximal direction, and thereby limit the penetration of the piercing member 468 through the membrane 457, which in turn limits the size of the open area of the hole or other rupture formed in the membrane 457. It is also possible to configure this mechanical stop such that its position, with respect to piston 467 or to piercing member 468 in the proximal direction, can be adjusted. In this manner, the mechanical stop can be moved towards or away from the membrane 457, either at the factory or via a suitable mechanism accessible by a user prior to firing/launching the projectile, thereby pre-setting the deployment time.

Operation of the warhead assembly 100 in projectile 10 can be as follows, for example:

In a first step, the projectile 10 comprising the warhead assembly 100 is fired from a weapons barrel (if the projectile is in the form of a shell) or launched (if the projectile is in the form of a rocket or missile), with the warhead assembly 100 in the retracted configuration.

In the next step, at a predetermined set of conditions, the warhead assembly 100 is deployed to the deployed configuration by activating the actuation mechanism 460. Essentially, the pyrotechnic charge is fired, resulting in a force being induced to the piston 467, which is thereby driven in the proximal direction, driving the piercing member 468 to rupture the membrane 457, releasing pressurized gas G to the body 420 and thus allowing the body 420 to become inflated. As the body 420 becomes inflated, its longitudinal dimension increases, thereby pushing apart the brackets 432 and 434 from one another, which results in the forward module 200 being spaced longitudinally from the aft module 300 by displacement Q to provide the deployed configuration. Concurrently, the nose 210 and the forward external side walls 220 are exposed, both in the retracted configuration and in the deployed configuration and during the whole deployment process. In other words, the external profile of the forward module 200, in particular of the nose 210 and forward external side walls 220, remains unchanged between the retracted configuration and the deployed configuration. In turn this allows the full cross-section or three-dimensional profile of the nose 210 and at least of part of the forward external side walls 220 to be utilized in full, for maximizing available space for the seeker head for example.

The predetermined set of conditions can include, for example, a predetermined time after firing/launch of the projectile, and/or a rate of velocity or acceleration, that indicate that the projectile is free of the weapons barrel or the launch equipment (for example a launch tube), and it is now safe to deploy the warhead assembly. Additionally or alternatively, the predetermined set of conditions can include, for example, the warhead assembly having reached a particular height, or range. Thus, suitable condition-determining devices (for example: an altimeter for sensing the height of the projectile; an inertial system for sensing distance travelled; an accelerometer for sensing acceleration of the projectile; a timer for determining elapsed time from firing/launch) can be provided and operatively coupled to the actuation mechanism 460 for activation thereof. Where there are different sets of conditions that do not coincide, a suitable controller and/or algorithm can be provided to choose between the different alternatives. Once in the deployment configuration, the main warhead is at the optimal stand-off distance SO with respect to the nose.

It is to be noted that at least in one variation of this example, the specific predetermined set of conditions can be set at the factory, or alternatively prior to firing/launching the projectile. For example, the condition-determining devices and/or controller/algorithms can be adjusted to enable actuation of actuation mechanism 460 at different sets of conditions.

In the next step, which is optional and depends whether or not the warhead assembly is fitted and functioning with a seeker head, the seeker head homes on to the desired target. Alternatively, if the projectile is being used ballistically, the projectile follows a ballistic trajectory to the nominal target position.

In the next step, the nose of the warhead assembly contacts the target and detonates. In doing so, any reactive armor that may be protecting the target is nominally destroyed or damaged, and concurrently the main warhead is detonated at the standoff distance, nominally maximizing the damage inflicted thereby to the target.

In the method claims that follow, alphanumeric characters and Roman numerals used to designate claim steps are provided for convenience only and do not imply any particular order of performing the steps.

Finally, it should be noted that the word "comprising" as used throughout the appended claims is to be interpreted to mean "including but not limited to".

While there has been shown and disclosed examples in accordance with the presently disclosed subject matter, it will be appreciated that many changes may be made therein without departing from the spirit of the presently disclosed subject matter.

The invention claimed is:

1. A warhead assembly for a projectile, the warhead assembly comprising a forward module including a precursor warhead;

an aft module including a main warhead; and a deployment system configured for selectively deploying the warhead assembly from a retracted configuration to a deployed configuration, at predetermined conditions, to thereby provide a longitudinal displacement between the forward module and the aft module;

wherein said deployment system includes an expansion member accommodated between the forward module and the aft module, the expansion member configured for being longitudinally expanded under said predetermined conditions to thereby increase a longitudinal dimension of the expansion member and thereby urge the forward module and the aft module away from one another to provide said longitudinal displacement;

wherein said expansion member is in the form of an inflatable member;

wherein said deployment system includes an actuation system for selectively inflating the inflatable member to provide said deployed configuration; and wherein said inflatable member includes a balloon-type body; and wherein said forward module includes a first side wall, and said aft module includes a second side wall;

wherein the forward module includes a nose of the projectile, and wherein said nose and said first side wall have an unchanged profile between the retracted configuration and the deployed configuration.

2. The warhead assembly according to claim 1, wherein said forward module and said aft module are telescopically movable longitudinally with respect to one another.

3. The warhead assembly according to claim 2, wherein at least one of:

said first side wall and said second side wall are telescopically movable longitudinally with respect to one another; or said expansion member is different from said first side wall or said second side wall.

4. The warhead assembly according to claim 1, wherein said actuation system includes a pressurized gas vessel having an outlet and a valve, the valve being operable to open under said predetermined conditions to allow fluid communication between said pressurized vessel and said inflatable member.

5. The warhead assembly according to claim 4, wherein said actuation system includes a pyrotechnic actuator configured for causing the valve to open under said predetermined conditions.

6. The warhead assembly according to claim 1, wherein the forward module includes a seeker head.

7. The warhead assembly according to claim 1, wherein said forward portion and said aft portion have respective external diameters that are within ±10% of one another.

8. The warhead assembly according to claim 1, wherein said predetermined conditions include at least one of:

a measure of a velocity or acceleration indicative of the projectile having been fired from a weapons barrel or other launch equipment and is now free thereof;

a predetermined time period after the projectile is fired from a weapons barrel or other launch equipment and is now free thereof; or the warhead assembly having reached a particular height, or range.

9. A warhead assembly for a projectile, the warhead assembly comprising a forward module including a precursor warhead;

an aft module including a main warhead; and a deployment system configured for selectively deploying the warhead assembly from a retracted configuration to a deployed configuration, at predetermined conditions, to thereby provide a longitudinal displacement between the forward module and the aft module;

wherein said deployment system includes an expansion member accommodated between the forward module and the aft module, the expansion member configured for being longitudinally expanded under said predetermined conditions to thereby increase a longitudinal dimension of the expansion member and thereby urge the forward module and the aft module away from one another to provide said longitudinal displacement, wherein said expansion member is in the form of an inflatable member;

wherein said deployment system includes an actuation system for selectively inflating the inflatable member to provide said deployed configuration and wherein said inflatable member includes a bellows-type body; and wherein the forward module includes a first side wall, and said aft module includes a second side wall;

wherein the forward module includes nose of the projectile, and wherein said nose and said first wall have an unchanged profile between the retracted configuration and the deployed configuration.

10. A warhead assembly for a projectile, the warhead assembly comprising a forward module including a precursor warhead;

an aft module including a main warhead; and a deployment system configured for selectively deploying the warhead assembly from a retracted configuration to a deployed configuration, at predetermined conditions, to thereby provide a longitudinal displacement between the forward module and the aft module;

wherein said deployment system includes an expansion member accommodated between the forward module and the aft module, the expansion member configured for being longitudinally expanded under said predetermined conditions to thereby increase a longitudinal dimension of the expansion member and thereby urge the forward module and the aft module away from one another to provide said longitudinal displacement;

wherein said forward module and said aft module are telescopically movable longitudinally with respect to one another;

wherein said forward module includes a first side wall, and said aft module includes a second side wall;

wherein the forward module includes a nose of the projectile, and said first side wall are exposed both in the retracted configuration and in the deployed configuration; and wherein said nose and said first side wall have an unchanged profile between the retracted configuration and the deployed configuration.

11. A projectile, comprising the warhead assembly according to claim 1.

12. A projectile according to claim 11, configured as one of a shell, a rocket or a missile.

13. A method for operating a warhead assembly, the method comprising:

providing the warhead assembly according to claim 1; and selectively deploying the warhead assembly from the retracted configuration to the deployed configuration under said predetermined conditions.

14. A deployment system for a warhead assembly for a projectile, the warhead assembly including a forward module having a precursor warhead and an aft module including a main warhead;

said deployment system configured for selectively deploying the warhead assembly from a retracted configuration to a deployed configuration, at predetermined conditions, to thereby provide a longitudinal displacement between the forward module and the aft module;

wherein said deployment system includes an expansion member configured for being accommodated between the forward module and the aft module, and configured for being longitudinally expanded under said predetermined conditions to thereby increase a longitudinal dimension of the expansion member and thereby urge the forward module and the aft module away from one another to provide said longitudinal displacement;

wherein said expansion member is in the form of an inflatable member;

an actuation system for selectively inflating the inflatable member to provide said deployed configuration;

wherein said inflatable member includes a balloon-type body; and wherein said forward module includes a first side wall, and said aft module includes a second side wall;

wherein the forward module includes a nose of the projectile, and wherein said nose and said first side wall have an unchanged profile between the retracted configuration and the deployed configuration.

15. The deployment system according to claim 14, wherein the first side wall and the second side wall being telescopically movable longitudinally with respect to one another, and wherein said expansion member is different from said first side wall or said second side wall.

16. The deployment system according to claim 14, wherein said actuation system includes a pressurized gas vessel having an outlet and a valve, the valve being operable to open under said predetermined conditions to allow fluid communication between said pressurized vessel and said inflatable member.

17. The deployment system according to claim 14, wherein said actuation system includes a pyrotechnic actuator configured for causing the valve to open under said predetermined conditions.

18. A warhead assembly for a projectile, the warhead assembly comprising a forward module including a precursor warhead;

an aft module including a main warhead; and a deployment system configured for selectively deploying the warhead assembly from a retracted configuration to a deployed configuration, at predetermined conditions, to thereby provide a longitudinal displacement between the forward module and the aft module;

wherein said deployment system includes an expansion member accommodated between the forward module and the aft module, the expansion member configured for being longitudinally expanded under said predetermined conditions to thereby increase a longitudinal dimension of the expansion member and thereby urge the forward module and the aft module away from one another to provide said longitudinal displacement;

wherein said forward module and said aft module are telescopically movable longitudinally with respect to one another;

wherein said forward module includes a first side wall, and said aft module includes a second side wall;

wherein the forward module includes a nose of the projectile, and wherein said nose and said first side wall have an unchanged profile between the retracted configuration and the deployed configuration.

19. A deployment system for a warhead assembly for a projectile, the warhead assembly including a forward module having a precursor warhead and an aft module including a main warhead;

said deployment system configured for selectively deploying the warhead assembly from a retracted configuration to a deployed configuration, at predetermined conditions, to thereby provide a longitudinal displacement between the forward module and the aft module;

wherein said deployment system includes an expansion member configured for being accommodated between the forward module and the aft module, and configured for being longitudinally expanded under said predetermined conditions to thereby increase a longitudinal dimension of the expansion member and thereby urge the forward module and the aft module away from one another to provide said longitudinal displacement;

wherein said expansion member is in the form of an inflatable member;

an actuation system for selectively inflating the inflatable member to provide said deployed configuration; and wherein said inflatable member includes a bellows-type body; and wherein said forward module includes a first side wall, and said aft module includes a second side wall;

wherein the forward module includes a nose of the projectile, and wherein said nose and said first side wall have a an unchanged profile between the retracted configuration and the deployed configuration.

* * * * *